United States Patent [19]

Nishikawa

[11] Patent Number: 4,903,419

[45] Date of Patent: Feb. 27, 1990

[54] METHOD OF AND APPARATUS FOR DREDGING SLUDGE IN HIGH DENSITY

[75] Inventor: Yutaka Nishikawa, Higashimurayama, Japan

[73] Assignee: TOA Corporation, Tokyo, Japan

[21] Appl. No.: 197,887

[22] Filed: May 24, 1988

[51] Int. Cl.[4] ..... E02F 3/92

[52] U.S. Cl. ..... 37/59; 37/66; 37/56; 37/73; 406/71; 406/135

[58] Field of Search ..... 37/66, 59, 60, 56, 67, 37/73, 195; 406/135, 134, 65, 71, 52

[56] References Cited

U.S. PATENT DOCUMENTS

| | | | |
|---|---|---|---|
| 2,346,180 | 4/1944 | Neumann | 37/67 |
| 3,842,521 | 10/1974 | Faldi | 37/59 X |
| 3,896,566 | 7/1975 | Van Der Gaag | 37/56 |
| 4,253,255 | 3/1981 | Durell | 37/59 X |

FOREIGN PATENT DOCUMENTS

| | | | |
|---|---|---|---|
| 1167927 | 10/1969 | United Kingdom | 406/135 |

*Primary Examiner*—Dennis L. Taylor
*Assistant Examiner*—J. Russell McBee
*Attorney, Agent, or Firm*—Armstrong, Nikaido, Marmelstein, Kubovcik & Murray

[57] ABSTRACT

A method of and apparatus for continuously dredging sludge deposited on an underwater bed, at a high density of the sludge, according to which digging and scooping devices are placed in an airtight hood opened at its bottom, which is applied on the intended underwater bed and into which air is then introduced to obtain a condition in which water is removed out of the hood, and the digging and scooping devices are then put into operation, whereby dredging is effected at a high efficiency in that the content of water in sludge being dredged is suppressed to a minimum, the sludge being transferred under pressure in a state of containing substantially no additional water than it naturally contains.

5 Claims, 4 Drawing Sheets

METHOD OF AND APPARATUS FOR DREDGING SLUDGE IN HIGH DENSITY

BACKGROUND OF THE INVENTION

This invention relates to a method of dredging up sludge, which is deposited on the bottom of the water, continuously in a high density and sending the resultant sludge under pressure to a predetermined place, and an apparatus used to practice this method.

In order to remove the sludge deposited on the bottom of the water in, for example, a dam and a harbor, a method of sending up the sludge with the water by using a dredging pump is employed. However, according to this dredging method in which a large quantity of water is sent up with the sludge, large power and equipment are required.

Moreover, in order to separate sludge from the muddy water sent up by a dredging pump, it is necessary to secure a vast land to be reclaimed from the sea. It is difficult to carry out a dredging operation in a place where such a vast land to be reclaimed from the sea is not available. Since the separating of sludge from the muddy water is generally done in a small land to be reclaimed from the sea, a lot of time is required to carry out the operation.

In order to dredge up the sludge efficiently by using small power and a small land to be reclaimed from the sea, it is necessary that the sludge be brought up from the bottom of the water continuously in a high density. To meet this requirement, it is desirable to send up the sludge with the shape of the layer thereof kept as it originally was while preventing to as great an extent as possible the water from mixing in the sludge. In a dredging operation carried out with a view to achieving this purpose, various types of sludge sucking devices which suit the purpose are used. For example, suction devices based on a centrifugal pump system and a pneumatic pump system have been proposed.

In these systems, the sludge deposited on the bottom of the water is sent up by sucking the sludge as it is into the pump, or agitating the sludge to increase the fluidity thereof and sucking the resultant sludge, which is akin to muddy water, into the pump. Accordingly, the sucked sludge of an increased fluidity flows into the suction port along the flow of the muddy water. In case of sucked sludge having a fluidity close to that of water, a channel of water is formed early in the sludge in most cases except the case where the sludge has, for example, a water content of not lower than 200% (namely, a content of water two times as large as the weight of dry sludge). Therefore, a large quantity of water is sucked with sludge, i.e., water the quantity of which is far larger than that of the sludge is necessarily sent up, so that the dredging efficiency greatly decreases.

As may be inferred from such phenomena, it is very difficult to dredge up sludge continuously in a high density by utilizing these suction devices and a flow of the muddy water, due to the principle that the water flows more smoothly than sludge. This makes it necessary to use a large suction device and large power.

A dredging apparatus in which the air is supplied to the upper portion of a casing, which is opened horizontally and provided with a screw horizontally therein, so as to discharge the water has also been developed. However, in this apparatus, water with sludge is fed from the front portion of a casing. Therefore, it is impossible to send up sludge with a high efficiency as in the above-described apparatus made according to the known techniques.

SUMMARY OF THE INVENTION

The present invention has been made to give solution to the problem that according to the above described conventional dredging methods and apparatus, it is indispensable to transfer a large quantity of water with sludge, and its primary object is to make it possible to effect a continuous dredging of underwater sludge at a high density of the latter by way of forming an air chamber from which water is removed away, at the intended underwater bed, digging and scooping sludge at the underwater bed in the air chamber, using mechanical means such as a bucket wheel having an open bottom and peripheral scraping claws, and transferring the dug and scooped sludge out of water with its content of water suppressed as much as possible.

In the dredging apparatus according to the present invention, a hood is provided on the outer side of a cutter wheel, and the dredging of sludge is done as the cutter wheel is rotated in an air chamber formed by supplying compressed air into this hood.

This dredging apparatus consists mainly of a stationary chamber adapted to store the dredged sludge therein and send the sludge to a pump, and a cutter wheel adapted to be rotated along the outer circumference of the stationary chamber, and having a plurality of bottom-opened scraping claws implanted in a cutter wheel body.

In a conventional dredging apparatus, the sludge is fluidized, sucked and then sent up, while, in the apparatus according to the present invention, the sludge is dug out in the air chamber by buckets or scraping claws with the occurrence of the mixing of water in the sludge prevented to as great an extent as possible, the resultant sludge being then sent under pressure to a sludge treatment plant through a pipe line in such a manner that the water is not substantially mixed in the sludge.

In a preferred embodiment of the present invention, a cutter wheel having scraping claws (bottom-opened buckets) rotatable around a horizontal shaft is used as a sludge digging means. In short, the significance of the present invention resides in that the water is replaced by the air to form an air chamber, in which the sludge is dug out and sent up as the shape of the layer thereof is kept substantially as it originally was. However, it necessarily occurs that the dredged sludge contains water to some measure, since sludge containing a large quantity of water is dug out during an operation of this dredging apparatus.

DESCRIPTION OF THE PREFERRED EMBODIMENT

An embodiment of the present invention will now be described.

Figure 4:
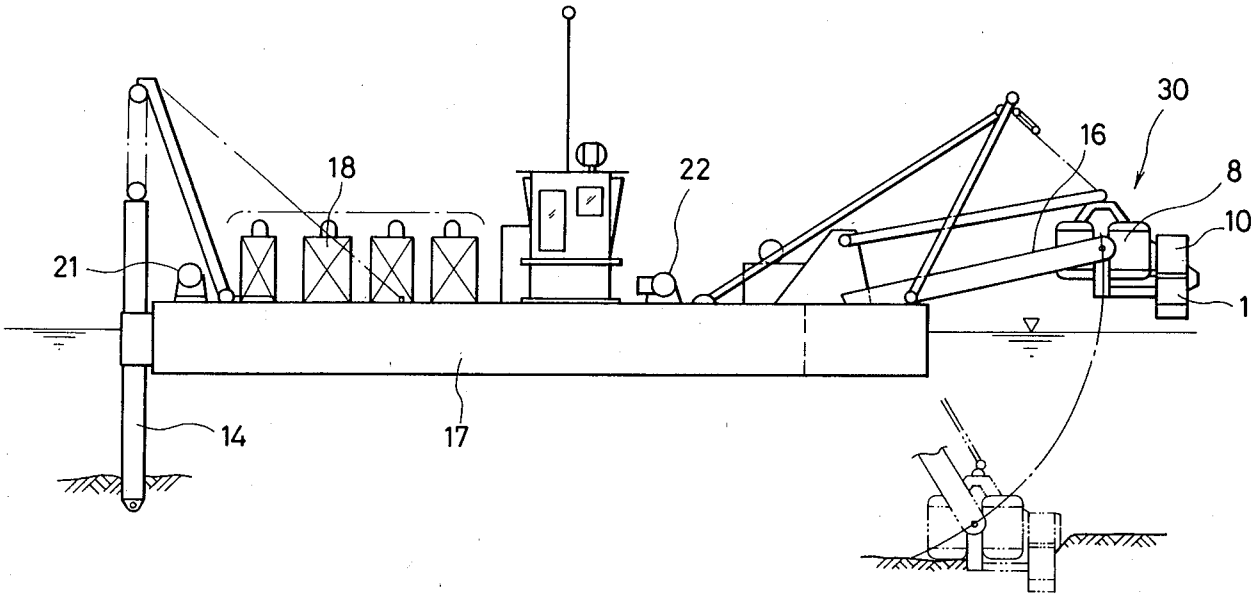
Figure 5:
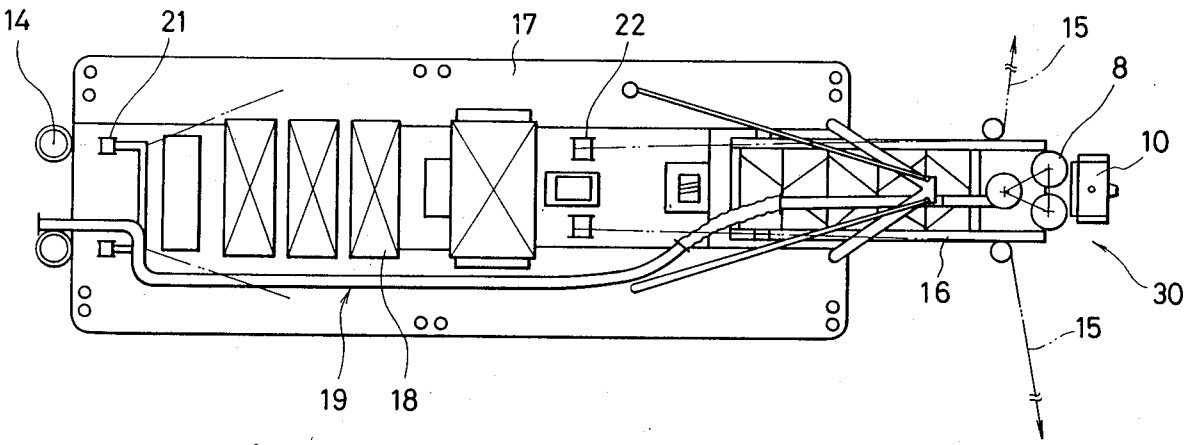
FIG. 5 shows a top plan view of the dredger of FIG. 4.

As shown in FIGS. 4 and 5, which are general construction diagrams of a dredger having an apparatus for dredging sludge in a high density, the dredger is provided at the front end portion of a dredger body 17 with a ladder 16 so that the ladder 16 can be moved pivotally in the vertical direction, and at the rear end portion thereof with a spud 14 fitted vertically therein. The spud 14 is moved vertically by a spud winch 21 and implanted in the seabed to be utilized as a fulcrum of a swinging movement of the dredger body 17. Two swing wires 15 are wrapped around rollers at the front end portions of the ladder 16 so as to extend to left and right. The dredger body 17 is swung reciprocatingly by moving these swing wires 15 by operating swing winches 22 and thereafter moved forward.

An apparatus 30 for dredging sludge in a high density is provided at the front end of the ladder 16, and it is adapted to dig out sludge as it is swung to left and right in accordance with the movements of the dredger body 17.

Figure 1:
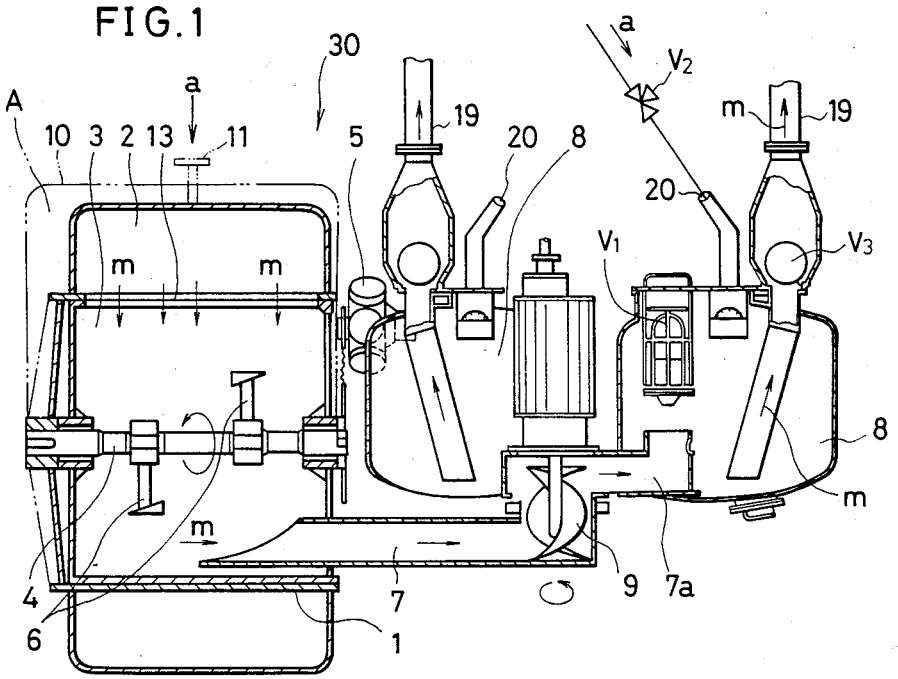
FIG. 1 is a longitudinal sectional view, showing a whole of the dredging apparatus according to the present invention.
Figure 2:
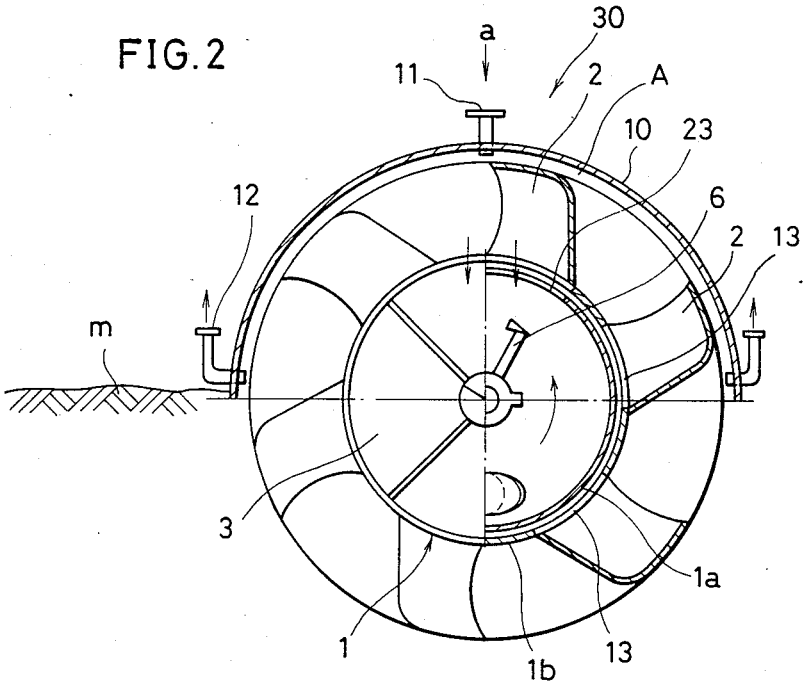
FIG. 2 is a cross-sectional view of the apparatus of FIG. 1, in which a left-hand half portion shows a front view of the cutter wheel in the apparatus and a right-hand half portion shows a front view in section of the cutter wheel and the interior of the storage tank mounted inner to the cutter wheel.
Figure 3:
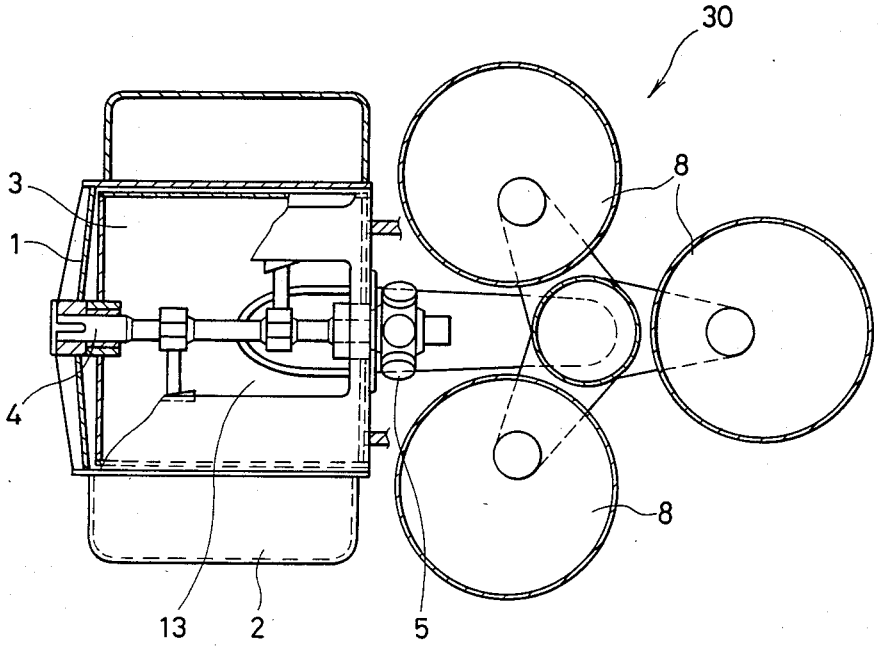
FIG. 3 is a plan view, showing the apparatus of FIG. 1 with the cutter wheel and the storage tank partly cut away and in section; and, FIG. 4 shows a side elevational view, taken for illustration of a whole of a dredger equipped with the apparatus for dredging sludge in high density according to the present invention.

In this dredging apparatus 30, a cutter wheel 1 having a plurality of scraping claws 2 implanted radially in a cutter wheel body is fitted around the outer circumference of a sludge storage tank 3 closed at its front and rear sides and provided at its upper portion with an opening 23 from which sludge is introduced thereinto, as shown in FIGS. 1–3. The cutter wheel 1 is mounted rotatably on a shaft 4, and the power generated by a driving unit 5 is transmitted to the shaft 4 by utilizing a driving means, such as a chain sprocket, to rotate the cutter wheel 1 and carry out a dredging operation.

On the outer side of the outer circumferential portion of the cutter wheel 1, a semicylindrical hood 10 is provided, which is adapted to store supplied compressed air therein to form an air chamber. The cutter wheel 1 is rotated within the hood 10, and sludge is dredged in the air chamber.

The cutter wheel 1 comprises of a cylindrical member 1*b* fitted rotatably around the outer circumference of a circumferential wall 1*a* of the storage tank 3, a plurality of sludge inlets 13 provided at regular intervals along the surface of the cylindrical member 1*b*, and bottom-opened scraping claws 2 radially disposed in the portions of the sludge inlets 13.

The sludge storage tank 3 is a horizontally disposed cylindrical tank provided with an opening 23 at the upper portion thereof, and a sludge suction port 7 at the lower portion thereof. The shaft 4 for driving the cutter wheel 1 fitted around the outer circumference of this sludge storage tank 3 is provided thereon with agitator wings 6, which are rotated in the storage tank 3 to agitate the sludge introduced thereinto, and set the same ready to be sent up under pressure easily.

The sludge dug out by the scraping claws 2 as the cutter wheel 1 is rotated is supplied at the highermost portion of the sludge storage tank 3 into the opening 23 thereof through the bottom openings of the scraping claws 2. The sludge is then stirred by the agitator wings 6 in the storage tank 3 and transferred to pneumatic pumps 8 via the sludge suction port 7. A passage continuing from the sludge suction port 7 is provided therein with an auxiliary wing 9, whereby the sucked sludge is pressurized and transferred to the pneumatic pumps 8.

How to operate the dredging apparatus according to the present invention will now be described.

The substantially upper half portion of the cutter wheel 1, which is rotated around the fixed sludge storage tank 3 as mentioned above, is surrounded by the hood 10. The compressed air a sent from air compressors 18 on the dredger body 17 is supplied from an air supply port 11 provided in the hood 10, and discharged at a flow rate of not lower than a predetermined level from air discharge ports 12.

Accordingly, the portion of the cutter wheel which is exposed to the air and the sludge storage tank 3 form an air chamber (gaseous atmosphere) within the hood 10. Therefore, the entry of the water existing around the scraping claws 2 into the cutter wheel 1 and sludge storage tank 3 can be prevented while the sludge is dredged by the scraping claws 2.

When the cutter wheel 1 is driven by the driving unit 5 as mentioned above, the sludge m is dredged by the scraping claws 2, and lifted and introduced from the opening 23, which is provided at the upper portion of the sludge storage tank 3, into the interior of the same tank 3. As the cutter wheel 1, agitator wings 6 in the sludge storage tank 3 are rotated, so that the sludge m introduced thereinto is stirred by the agitator wings 6 and becomes softened to an increased fluidity, and it is then supplied to the sludge suction port 7 due to the pressure of the air a and the sludge-forwarding effect of the agitator wings 6

The sludge m in the sludge storage tank 3 is sucked from the sludge suction port 7, pressurized by the sludge pressurizing auxiliary wing 9, sent into a pump unit consisting of three pneumatic pumps 8, and then transferred under pressure from the upper side of the dredger body 17 to a sludge treatment plant (not shown) through a sludge discharge pipe line 19.

In each of the pneumatic pumps 8, a one-way valve $V_1$ is provided above the open end of a supply port 7*a* for the sludge m, and adapted to be opened by the pressure of the sludge m. When the sludge m is supplied with a compressed air supply port 20 opened to the atmospheric air via a three-way valve $V_2$, the one way valve $V_1$ is opened, and the sludge m is supplied to the interior of a casing. When the casing is filled up with the sludge m, the three-way valve $V_2$ is shifted to a position in which the compressed air a can be supplied. When the compressed air a is supplied to the casing, the pressure thereof causes the sludge m to open a valve $V_3$ to send the sludge m under pressure to a predetermined place through the pipe line 19.

The apparatus 30 for dredging sludge in a high density, which is constructed as described above, has elements which enable the sludge m on the bottom of the water to be dredged continuously in a high density. This apparatus 30 has scraping claws 2 of a predetermined capacity, by which the sludge m is dug out and collected continuously.

The sludge is dug out by the scraping claws 2 with the cutter wheel 1 rotated around the outer circumference of the sludge storage tank 3, and it is then supplied to the air chamber A from which the water has been discharged by the compressed air a supplied to the interior of the hood 10. The sludge m in the sludge storage tank 3 is agitated and receives a differential pressure due to the depth of the water substituted by the compressed air a. The sludge is then further pressurized by the auxiliary wing 9 provided in the sludge suction port 7, and supplied into the casing of each pump 8. The sludge m supplied to the interior of the pump 8 is pressurized with the compressed air a and discharged.

The above-described dredging operation is carried out as the apparatus 30 is moved laterally by drawing the swing wires 15, the lateral movement of the apparatus 30 being made around the spud 14 provided at the rear end of the dredger body 17.

The scraping claws 2 provided in the circumferential portion of the cutter wheel 1 dig out the deposited sludge and take the same in the sludge storage tank 3 as they are moved in the above-mentioned manner. The sludge, which has been dug out in the air chamber A in the hood 10, in the scraping claws 2 is discharged to the sludge storage tank 3, so that the water existing around the hood 10 is not mixed in the sludge m. Accordingly, only the sludge m on the bottom of the water enters the storage tank 3, and a very small quantity of water, if any, is mixed in this sludge. Therefore, sludge having a water content far lower than that of the sludge dug out by a conventional dredging method is dredged and transferred to a treatment plant.

The sludge thus taken in the sludge storage tank 3 is stirred by the agitator wing 6. The fluidity of the sludge m is improved, and this sludge is pushed by the air pressure in the storage tank 3 to flow through the sludge suction port 7. The sludge is then pressurized by the auxiliary wing 9, and flows into the pneumatic pumps 8.

The sludge m thus supplied to each pneumatic pump 8 is discharged to a treatment plant through the pipe line 19 by the compressed air a from the compressed air supply port 20. A dredging operation is carried out in this manner.

The sludge deposited on the bottom of the water is thus dug out by the cutter wheel 1 in the dredging apparatus 30, taken in the pumps 8 and then discharged therefrom. Therefore, the possibility that the water is mixed in the dredged sludge can be kept extremely low. This enables the sludge to be dredged continuously in a high density.

Since the dredging apparatus 30 in this embodiment is provided with an auxiliary wing 9 for pressurizing the sludge m from the sludge tank 3 and sending the resultant sludge to the relative pump 8, the generation of the force for forwarding the sludge m to the interior of the pump 8 is promoted by the sludge sucking and pressurizing effect of the auxiliary wing 9 even when a pressure difference required to forward the sludge into the pump 8 is not so large due to the small depth of the water in which the dredging operation is carried out.

In the above-described embodiment, the cutter wheel 1 having scraping craws implanted in the circumferential portion thereof is mounted on a horizontal shaft and rotated therearound. Some other type of cutter, for example, a screw type cutter can also be used as long as it is capable of forming an air chamber in a sludge digging portion thereof.

The hood consists of a metal or a reinforced synthetic resin. If elastic sheets consisting of rubber are provided at the lower edge portions of the hood as parts functioning as packings, so as to form an air chamber effectively, superior effect can be obtained.

In the apparatus for dredging sludge in a high density according to the present invention, sludge is collected in an air chamber by digging out the bottom of the water mechanically by a cutter wheel which is capable of digging out the sludge deposited on the bottom of the water. Therefore, the collecting of sludge can be done reliably. In addition, since the dredged sludge is introduced into the sludge storage tank which is adapted to prevent water from entering, the sludge can be collected without permitting the environmental water around the hood to enter the sludge.

The air pressure in the air chamber formed in the interior of the hood is applied as it is to the sludge surface in the sludge storage tank. This enables the dredged sludge to be sent up continuously in a high density with a high efficiency.

I claim:

1. Apparatus for dredging sludge in a high density, comprising a sludge storage tank; a cutter wheel rotatable around said sludge storage tank, said sludge storage tank having an inlet port and a discharge port for the sludge dug out by said cutter wheel, said cutter wheel including a cylindrical member rotatably mounted around the circumference of said sludge storage tank in close proximity thereto and having sludge introducing ports registering with said inlet port of said storage tank as said cutter wheel is rotated therearound, and bottom-opened scraping claws implanted in the portions of said cylindrical member adjacent said sludge introducing ports provided therein; and a hood extending around a part of the outer circumference of said cutter wheel and forming an air chamber therein, said hood having means for supplying compressed air to the interior of said hood; said sludge storage tank having agitator wings and means for rotating said wings; said cutter wheel being rotatable around the outer circumference of said sludge storage tank; said hood covering the upper portion of said cutter wheel; said compressed air supply means including means for supplying compressed air at a pressure lower than the pressure of the water in the interior of said hood.

2. Apparatus for dredging sludge in a high density, comprising a sludge storage tank; a cutter wheel rotatable around said sludge storage tank, said sludge storage tank having an inlet port and a discharge port for the sludge dug out by said cutter wheel, said cutter wheel including a cylindrical member rotatably mounted around the circumference of said sludge storage tank in close proximity thereto and having sludge introducing ports registering with said inlet port of said storage tank as said cutter wheel is rotated therearound, and bottom-opened scraping claws implanted in the portions of said cylindrical member adjacent said sludge introducing ports provided therein; and a hood extending around a part of the outer circumference of said cutter wheel and forming an air chamber therein, said hood having means for supplying compressed air to the interior of said hood; said apparatus further including pneumatic pumps receiving the sludge from said sludge storage tank and pumping the sludge elsewhere, each of said pneumatic pumps including means for intermittently pumping the sludge.

3. Apparatus for dredging sludge in a high density, comprising a cylindrical sludge storage tank; a cutter wheel for rotation around said tank; a hood covering said cutter wheel; a pneumatic pump; and, a sludge pressurizing auxiliary wing for pressurizing sludge feed from said storage tank to said pneumatic pump;

said sludge storage tank having agitator wings inside said storage tank for agitating sludge therein and having, in an outer portion thereof, an opening for charging sludge into said tank and, in a lower side portion thereof, a sludge suction port for feeding sludge into said pneumatic pump;

said cutter wheel including a cylindrical member rotatable around said sludge storage tank and a plurality of scraping claws, said cylindrical member being peripherally formed with sludge inlets comprising a plurality of through-holes and mounted with its inner periphery disposed close to the outer periphery of said sludge storage tank, said scraping claws being secured to said cylindrical member on the side of a rear end of said sludge inlets relative to the direction of rotation of said cylindrical member;

said hood having a lower open end located below said storage tank opening and having an air supply port for supplying compressed air into said hood and an air chamber between said hood and said sludge storage tank;

said auxiliary wing being mounted in said sludge suction port in said sludge storage tank.

4. Apparatus as claimed in claim 3, wherein said pneumatic pump is connected to said sludge suction port through a one-way valve and a discharge pipeline for sending sludge elsewhere is connected to an air supply port for supplying compressed air to aide sludge being sent elsewhere.

5. Apparatus as claimed in claim 3 or 4, wherein said pneumatic pump includes at least two pumps, each of said pumps selectively receiving sludge directly from said sludge suction port.

* * * * *